US011849297B2

(12) United States Patent
Tiene et al.

(10) Patent No.: US 11,849,297 B2
(45) Date of Patent: Dec. 19, 2023

(54) BALANCED ACOUSTIC DEVICE WITH PASSIVE RADIATORS

(71) Applicant: Bose Corporation, Framingham, MA (US)

(72) Inventors: Michael Tiene, Concord, NH (US); Roman N. Litovsky, Newton, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 17/643,908

(22) Filed: Dec. 13, 2021

(65) Prior Publication Data

US 2023/0188895 A1 Jun. 15, 2023

(51) Int. Cl.

| | |
|---|---|
| ***H04R 19/02*** | (2006.01) |
| ***H04R 7/04*** | (2006.01) |
| ***H04R 1/28*** | (2006.01) |

(52) U.S. Cl.

CPC ..... *H04R 7/045* (2013.01); *H04R 1/2834* (2013.01); *H04R 19/02* (2013.01); *H04R 2205/024* (2013.01)

(58) Field of Classification Search

CPC .. H04R 1/2815; H04R 1/2819; H04R 1/2823; H04R 7/045; H04R 19/02; H04R 2205/024

(Continued)

(56) References Cited

U.S. PATENT DOCUMENTS 4,549,631 A 10/1985 Bose
5,150,417 A * 9/1992 Stahl ..... H04R 1/2826 381/349

(Continued)

OTHER PUBLICATIONS

The International Search Report and the Written Opinion of the International Searching Authority, International Application No. PCT/US20221080471, pp. 1-18, dated May 15, 2023.

(Continued)

*Primary Examiner* — Suhan Ni

(74) *Attorney, Agent, or Firm* — BOND, SCHOENECK & KING, PLLC

(57) ABSTRACT

An acoustic device including a first passive radiator structure and a second passive radiator structure is provided. The first passive radiator structure includes a passive diaphragm mechanically coupled to a first enclosure member via a first flexible suspension element, and is configured to vibrate relative to the first enclosure member. The second passive radiator structure includes a second enclosure member, and is configured to vibrate relative to the first enclosure member. The second passive radiator structure further includes a second flexible suspension element mechanically coupled to the first enclosure member and the second enclosure member. The second passive radiator structure further includes an active electro-acoustic transducer mechanically coupled to the second enclosure member. The second passive radiator structure moves when the active electro-acoustic transducer vibrates. A first mass of the first passive radiator structure is less than a second mass of the second passive radiator structure. During operation, the first enclosure member experiences substantially no vibrations.

24 Claims, 5 Drawing Sheets

(58) Field of Classification Search
USPC ..... 381/349
See application file for complete search history.

(56) References Cited

U.S. PATENT DOCUMENTS

| | | | | |
|---|---|---|---|---|
| 6,704,426 | B2 * | 3/2004 | Croft, III | H04R 1/2842 381/345 |
| 7,454,025 | B2 * | 11/2008 | Saiki | H04R 1/2819 381/349 |
| 8,189,841 | B2 | 5/2012 | Litovsky et al. | |
| 8,565,463 | B2 * | 10/2013 | Saiki | H04R 1/2811 381/345 |
| 9,525,932 | B2 | 12/2016 | Litovsky et al. | |
| 9,571,934 | B2 | 2/2017 | Stabile | |
| 10,110,990 | B2 | 10/2018 | Litovsky et al. | |
| 10,271,129 | B2 | 4/2019 | Litovsky et al. | |
| 10,667,039 | B2 | 5/2020 | Litovsky et al. | |
| 2013/0195311 | A1 | 8/2013 | Sahyoun | |
| 2015/0281844 | A1 | 10/2015 | Stabile | |
| 2019/0297425 | A1 | 9/2019 | Huang | |

OTHER PUBLICATIONS

Invitation to Pay Additional Fees and, Where Applicable, Protest Fee, International Patent Application No. PCT/US2022/080471, pp. 1-12, dated Mar. 21, 2023.

* cited by examiner

BALANCED ACOUSTIC DEVICE WITH PASSIVE RADIATORS

BACKGROUND

Aspects and implementations of the present disclosure are generally directed to acoustic devices with one or more passive radiators.

A passive radiator is an acoustic driver, such as a loudspeaker, without a voice coil or magnet assembly. The passive radiator is not connected to an electrical circuit carrying a signal to convert to audio. Instead, the passive radiator uses sound pressure (often generated by an active radiator) trapped in an enclosure to vibrate a diaphragm and generate audio. In some examples, an acoustic device uses a pair of passive radiators of the same effective vibration area and the same effective vibration mass disposed in mutual opposition on the enclosure. The vibration-reaction forces of the opposing passive radiators are thereby mutually cancelled, thus reducing enclosure vibrations. This arrangement allows for powerful bass output due to enclosures resonating at low frequencies, such as 40 Hz. Passive radiators resonate at frequencies determined by their mass and effective stiffness (defined by the box volume and area of the radiator). The resonant frequency of the passive radiator may be adjusted by adding weight to the radiator. Adding this additional mass results in heavy acoustic devices, thus limiting their usefulness in portable products or products in which weight is a concern. Further, this additional mass can also require a larger enclosure volume, increasing the overall size of the acoustic device. Accordingly, there is a need for an acoustic device with a passive radiator configured to be balanced without additional mass and/or volume.

SUMMARY

The present disclosure relates to balanced acoustic devices with opposing passive radiator structures. The opposing passive radiator structures are arranged on opposite sides of an enclosure formed by first and second enclosure members. A first radiator structure includes a passive diaphragm. The passive diaphragm generates sound based on sound pressure trapped within the enclosure. The passive diaphragm is mechanically coupled to the first enclosure member via a first flexible suspension element. The second radiator structure includes an active electro-acoustic transducer. The active electro-acoustic transducer includes an active diaphragm configured to generate sound based on an electrical signal received from electrical circuitry. The active electro-acoustic transducer is mechanically coupled to a second enclosure member. The second enclosure member is coupled to the first enclosure member via a second flexible suspension element. As the active electro-acoustic transducer receives an electrical signal, the active diaphragm vibrates, and sound pressure is trapped within the enclosure. The incorporation of the active electro-acoustic transducer and the second enclosure member into the second radiator structure results in the second radiator structure having a much larger mass than the first radiator structure. Accordingly, the first radiator structure experiences much more significant displacement than the second radiator structure. This displacement is translated into sound via the passive diaphragm of the first radiator structure. Further, the effective radiating areas of the radiator structures are substantially equal, and the radiator structures have substantially collinear vibration axes. As both radiator structures experience the same sound pressure within the enclosure, both radiator structures generate the same forces, resulting in a force-balanced acoustic device.

Generally, in one aspect, an acoustic device is provided. The acoustic device includes a first passive radiator structure. The first passive radiator structure includes a passive diaphragm. The passive diaphragm is mechanically coupled to a first enclosure member via a first flexible suspension element. According to an example, the first enclosure member is inflexible. According to a further example, the passive diaphragm is configured to vibrate relative to the first enclosure member.

The acoustic device further includes a second passive radiator structure. The second passive radiator structure includes a second enclosure member. According to an example, the second enclosure member is inflexible. According to a further example, the second passive radiator structure is configured to vibrate relative to the first enclosure member.

The second passive radiator structure further includes a second flexible suspension element. The second flexible suspension element is mechanically coupled to the first enclosure member and the second enclosure member. The second suspension element may be a gasket The second passive radiator structure further includes an active electro-acoustic transducer. The active electro-acoustic transducer is mechanically coupled to the second enclosure member. The second passive radiator structure moves when the active electro-acoustic transducer vibrates. A first mass of the first passive radiator structure is less than a second mass of the second passive radiator structure. According to an example, the active electro-acoustic transducer is rigidly mounted to the second enclosure member.

According to an example, the passive diaphragm is configured to vibrate along a first vibration axis, and the second passive radiator structure is configured to vibrate along a second vibration axis. Further to this example, the first vibration axis and the second vibration axis may be substantially parallel or substantially collinear. According to another example, the first passive radiator structure and the second passive radiator structure vibrate in opposition.

According to an example, a stiffness ratio of a first stiffness of the first passive radiator structure to a second stiffness of the second passive radiator structure may be substantially equal to a mass ratio of the first mass to the second mass. According to a further example, a first Q-factor of the first passive radiator structure is substantially equal to a second Q-factor of the second passive radiator structure. According to an even further example, a first effective radiating area of the first passive radiator structure is substantially equal to a second effective radiating area of the second passive radiator structure.

According to an example, the first enclosure member, the second enclosure member, and the second flexible suspension element form an enclosure. Pressure changes within the enclosure generated by the active electro-acoustic transducer may apply a first force to the first passive radiator structure and a second force to the second passive radiator structure. The first force and the second force may be balanced. According to a further example, the first force displaces the passive diaphragm by a first displacement distance, the second force displaces the second passive radiator structure by a second displacement distance, and the first displacement distance is greater than the second displacement distance.

According to an example, the acoustic device further includes a rigid structure. The rigid structure is coupled to the first enclosure member. The rigid structure is configured to support the first enclosure member. The rigid structure may include at least one of a threaded mount, one or more feet, and a mounting plate.

Generally, in another aspect, an acoustic device is provided. The acoustic device includes an enclosure. The acoustic device further includes a first passive radiator structure. The first passive radiator structure includes a first passive diaphragm. The first passive diaphragm is mechanically coupled to the enclosure via a first flexible suspension element.

The acoustic device further includes a second passive radiator structure. The second passive radiator structure includes a second passive diaphragm. The second passive diaphragm is mechanically coupled to the enclosure via a second suspension element.

The second radiator structure further includes an active electro-acoustic transducer. The active electro-acoustic transducer is mechanically coupled to the second passive diaphragm. The second passive radiator structure moves when the active acoustic transducer vibrates. A first mass of the first passive radiator structure is less than a second mass of the second passive radiator structure.

The acoustic device further includes a flexible spider mechanically coupling the active electro-acoustic transducer to the enclosure.

According to an example, pressure changes within the enclosure displace the first passive diaphragm and the second passive radiator structure relative to the enclosure. The first passive diaphragm may be displaced at a greater distance than the second passive radiator structure. The first passive diaphragm may be configured to vibrate along a first vibration axis, and the second passive diaphragm may be configured to vibrate along a second vibration axis. The first vibration axis and the second vibration axis may be substantially parallel or substantially collinear.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also can appear in any disclosure incorporated by reference should be accorded a meaning most consistent with the particular concepts disclosed herein.

Other features and advantages will be apparent from the description and the claims.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the various examples.

DETAILED DESCRIPTION

Figure 1:
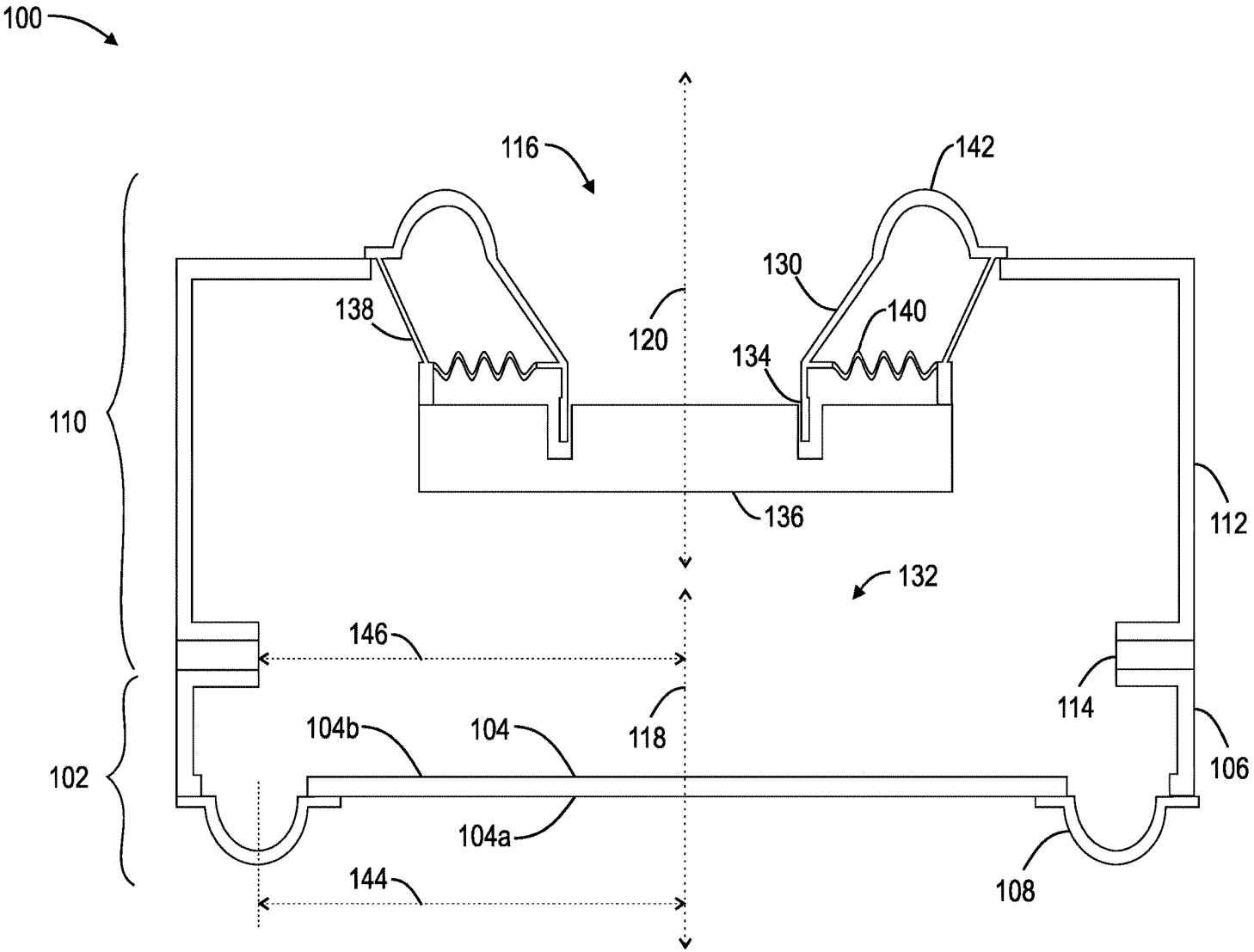
FIG. 1 is a cross-sectional view of an acoustic device, according to an example.

The present disclosure relates to balanced acoustic devices with opposing radiator structures. The opposing radiator structures are arranged on opposite sides of an enclosure formed by first and second enclosure members. The first and second enclosure members may be inflexible material, such as a rigid plastic or metal. A first radiator structure includes a passive diaphragm. The passive diaphragm generates sound based on sound pressure trapped within the enclosure. The passive diaphragm is mechanically coupled to the first enclosure member via a first flexible suspension element, such as a single or double-roll of flexible material.

The second radiator structure includes an active electro-acoustic transducer. The active electro-acoustic transducer includes an active diaphragm configured to generate sound based on an electrical signal received from electrical circuitry, such as an audio amplifier. The active electro-acoustic transducer is mechanically coupled to a second enclosure member. The second enclosure member is coupled to the first enclosure member via a second flexible suspension element, such as a gasket. The second flexible suspension element effectively vibrationally compensates for the vibrational forces of the first radiator structure from the second radiator structure.

As the active electro-acoustic transducer receives an electrical signal, the active diaphragm vibrates, and sound pressure is trapped within the enclosure. The incorporation of the active electro-acoustic transducer and the second enclosure member into the second radiator structure results in the second radiator structure having a much larger mass than the first radiator structure. Accordingly, the first radiator structure experiences much more significant displacement than the second radiator structure. This displacement is translated into sound via the passive diaphragm of the first radiator structure. Further, the effective radiating areas of the radiator structures are substantially equal, and the radiator structures have substantially collinear vibration axes. As both radiator structures experience the same sound pressure within the enclosure, both radiator structures generate substantially equal forces, resulting in a force-balanced acoustic device.

Crucial to the balance of the radiator structures, both radiator structures are configured to have the same resonant frequency, meaning that each radiator structure experiences peak vibration amplitude at the same frequency. The resonant frequency of each radiator structure is determined by the ratio of the mass of the radiator structures to the effective stiffness of the radiator structures. The effective stiffness of each radiator structure is defined by the radiator area, box volume, and flexibility of the suspension elements and the diaphragms. Further, both radiator structures may be configured to have substantially equal Q-factors, ensuring force-balancing throughout the frequency spectrum.

This force balance, along with the second flexible suspension element, vibrationally compensates the first radiator structure, such that the first enclosure member experiences substantially no vibrations. Eliminating vibrations in the first enclosure element enables the acoustic device to be securely coupled to a static receptacle or surface. For example, a rigid base may be mounted to the first enclosure member. The rigid base could further include a threaded mount configured to engage with a light bulb socket.

FIG. 1 is a cross-sectional view of an acoustic device 100. The acoustic device 100 is configured to both actively and passively generate audio based on an electrical signal received by an active electro-acoustic transducer 116. The acoustic device 100 can be defined in terms of a first passive radiator structure 102 and a second passive radiator structure 110.

The first passive radiator structure 102 is defined by a passive diaphragm 104. The passive diaphragm 104 is configured to generate sound based on the internal pressure of the acoustic device 100. The example passive diaphragm 104 of FIG. 1 has an exterior side 104*a* and an interior side 104*b*. The interior side 104*b* is exposed to an interior cavity 132 formed by the acoustic device 100, while exterior side 104*a* faces the environment outside of the acoustic device 100. Thus, pressure changes within the interior cavity 132 cause the passive diaphragm 104 to vibrate and radiate sound. In one example, the passive diaphragm 104 vibrates along a first vibration axis 118. The passive diaphragm 104 may be constructed as a flat plate as shown in FIG. 1. Alternatively, the passive diaphragm 104 may be constructed according to any other passive diaphragm known in the art.

The first passive radiator structure 102 is further defined by a first enclosure member 106. In the case of a substantially cylindrical acoustic device 100, the first enclosure member 106 may be similarly cylindrical. The first enclosure member 106 may be an inflexible material, such as a rigid plastic or metal. The passive diaphragm 104 is mechanically coupled to the first enclosure member 106 via a first flexible suspension element 108. The first flexible suspension element 108 can be a single or double-roll of flexible material, such as rubber or foam. Accordingly, when the active electro-acoustic transducer 116 generates pressure within the interior cavity 132, the passive diaphragm 104 and the first flexible suspension element 108 vibrate relative to the first enclosure member 106.

With further reference to FIG. 1, the second passive radiator structure 110 is defined by a second enclosure member 112, a second flexible suspension element 114, and the active electro-acoustic transducer 116. The second enclosure member 112 may be shaped similarly to the first enclosure member 104, such as substantially cylindrical. Like the first enclosure member 106, the second enclosure member 110 may also be an inflexible material, such as a rigid plastic or metal. The second enclosure member 100 is mechanically coupled to the first enclosure member 106 via the second flexible suspension element 114. In one example, the second flexible suspension element 114 is a gasket. However, other types of flexible suspension elements may be used depending on the application, such as a bellows-type element.

The active electro-acoustic transducer 116 is mechanically coupled to the second enclosure member 112. In this configuration, the active electro-acoustic transducer 116 moves along with the rest of the second passive radiator structure 110. The active electro-acoustic transducer 116 may be any known type of active transducer. As shown in the example of FIG. 1, the active electro-acoustic transducer 116 includes an active diaphragm 130, a bobbin with voice coil 134, a magnet 136, a basket 138, an active transducer suspension 140, and an active transducer surround 142.

According to an example, the active electro-acoustic transducer 116 is rigidly mounted to the second enclosure member 112. For example, the active transducer surround 142 may be configured to remain static at the tuning frequency of the acoustic device 100, thus ensuring that the active electro-acoustic transducer 116 moves with the second passive radiator structure 112, while allowing the active electro-acoustic transducer 116 to generate audio based on received electrical audio signals.

When the active electro-acoustic transducer 116 receives an electrical audio signal, the components of the active electro-acoustic transducer 116 cause the active diaphragm 130 to vibrate. This vibration generates sound pressure external to the acoustic device 100, and is perceived by a user as output sound. The vibration also generates sound pressure within the interior cavity 132 of the acoustic device 100, as formed by the assembly of the first 102 and second 110 passive vibrating structures. This internal pressure causes the first passive vibrating structure 102 to be displaced by a first displacement distance, and the second passive vibrating structure 110 to be displaced by a second displacement distance. In one example, the first vibrating structure 102 is displaced along a first vibration axis 118, while the second vibrating structure is displaced along a second vibrating axis 120. In another example, the first 118 and second 120 vibration axes are substantially parallel.

In a preferred example with two passive vibrating structures 102, 110, the first 118 and second 120 vibration axes are substantially collinear. Aligning the vibration axes 118, 120 collinearly eliminates the possibility of unwanted vibrational torque to be applied to the first passive radiator structure. In further examples involving more than two passive radiator structures, collinearly aligning the vibration axes of each structure may be practically impossible. This example could include two passive radiator structures arranged opposite a single passive radiator structure, wherein the single passive radiator structure includes an active electro-acoustic transducer. In those examples, parallelly aligning the vibration axes of each structure may provide improved performance.

The second passive radiator structure 110 has a significantly higher mass than the first passive radiator structure 102, primarily due to the active electro-acoustic transducer 116, as well as, in part, due to the second enclosure member 112. Thus, as both passive radiator structures 102, 110 received the same internal sound pressure, the first passive radiator structure 102 is displaced significantly more than the second passive radiator structure 110. In one example, the first displacement distance is ten times the second displacement distance. Thus, the vast majority of the internal sound pressure generated by the active electro-acoustic transducer 116 is translated into audible sound by the passive diaphragm 104.

The resonant frequency of the acoustic device 100 comprising the passive radiator structures 102, 110 is determined by the masses and effective stiffnesses of each of the structures 102, 110. In one example, the acoustic device 100 may be tuned for a low frequency resonant frequency, such as 40 Hz.

In an optimized configuration, a stiffness ratio of a first stiffness of the first passive radiator structure 102 to a second stiffness of the second passive radiator structure 110 is substantially equal to a mass ratio of the first mass to the second mass. This relationship ensures that each both passive radiator structures 102, 110 have the same free air resonant frequency. In a further optimization, the first passive radiator structure 102 may have a first Q-factor substantially equal to a second Q-factor of the second passive radiator structure 110.

Figure 2:
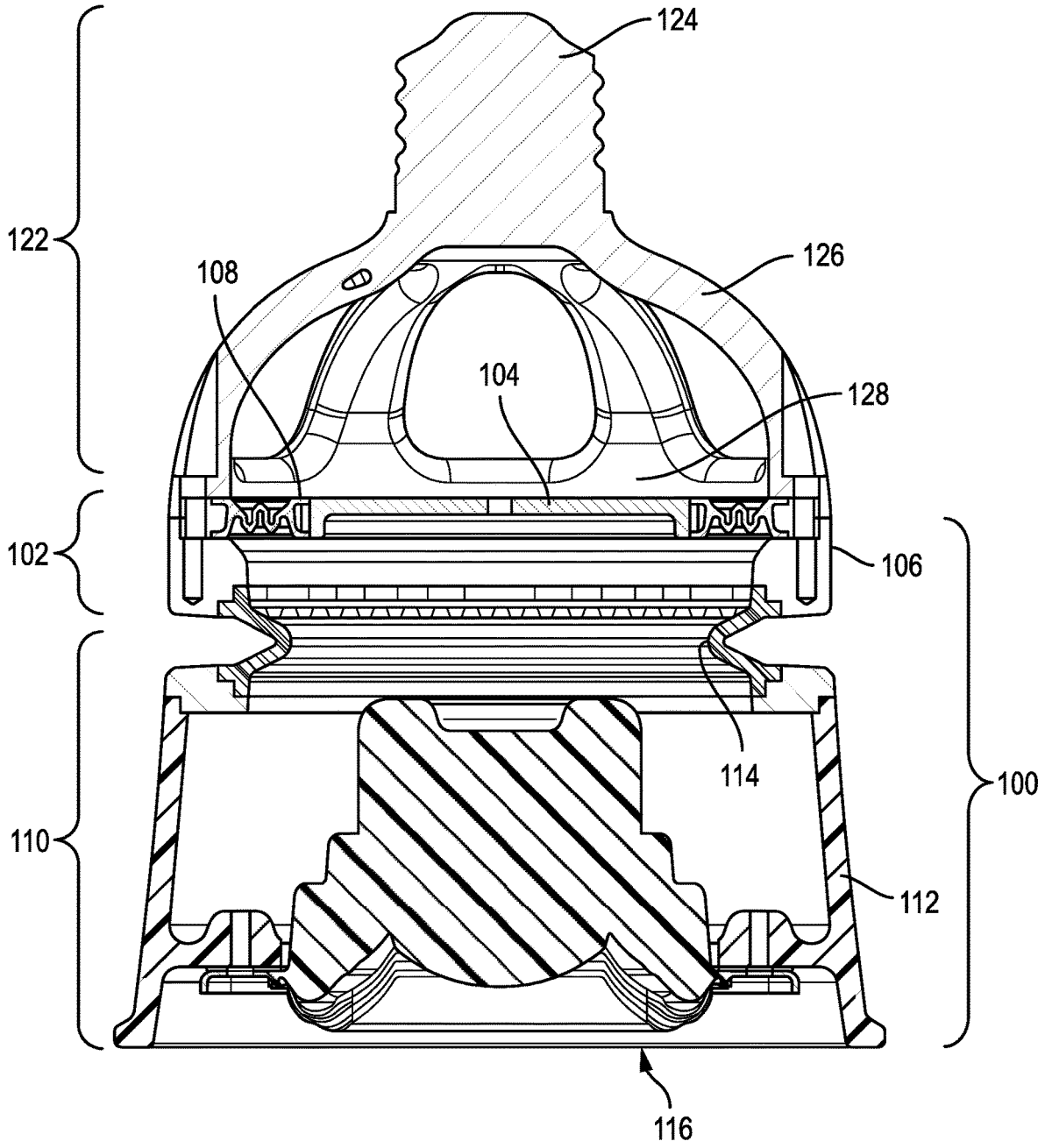
FIG. 2 is a cross-sectional view of a light bulb assembly including an acoustic device, according to an example.

According to a further example, the passive radiator structures 102, 110 have substantially equal effective radiating areas. The effective radiating area of the first passive radiating structure is defined by first radius 144, corresponding to the first flexible suspension element 108. The effective radiating area of the second passive radiator structure 110 is defined by a second radius 146, corresponding to the second flexible suspension element 114. As shown in FIG. 2, the first radius 144 and the second radius 146 are substantially equal, resulting in the passive radiator structures having substantially equal effective radiating areas.

As both passive radiator structures 102, 110, are exposed to the same interior cavity 132, both passive radiator structures 102, 110 are exposed to the same pressure within the interior cavity 132. Further, since both passive radiator structures 102, 110 have substantially the same effective radiating area, the resultant forces on each passive radiator structure 102, 110 are substantially equal. Thus, the acoustic device 100 is force balanced, and vibrates much less than devices with passive radiators of unequal area. In particular, the arrangement of the second flexible suspension element 114 between the first 106 and second 112 enclosure members results in little to no unwanted vibrations of the first passive radiator structure 102.

Further, as previously mentioned, the first passive radiator structure 102 is displaced significantly more during operation than the second passive radiator structure 110 (which includes active electro-acoustic transducer 116). This arrangement provides a number of advantages over previous designs. First, the first passive radiator structure 102 includes no electrical connections or components, and is therefore much more reliable than a similarly displaced structure with electrical connections strained by movement. Second, the low mass and low moment of inertia of the first passive radiator structure 102 results in a high rocking frequency. This higher rocking will be higher than frequency at which the first passive radiator would vibrate, greatly reducing rocking motions. Third, significant displacement of a passive radiator structure including an active electro-acoustic transducer would result in noticeable intermodulation distortion. By concentrating the displacement in the first passive radiator structure 102, these intermodulation distortions are significantly limited or reduced.

Further, other balanced passive radiator designs utilize a single enclosure member, rather than the first enclosure member 106 and second enclosure member 112 shown in FIG. 1. In these other designs, the second flexible suspension element 114 couples the active electro-acoustic transducer 136 to the single enclosure member, rather than coupling two enclosure members together. In order to ensure that the effective radiating areas of each radiator structure are substantially equal, the radii 144, 146 of each flexible suspension element 108, 114 must similarly be substantially equal. This significantly restrict the potential sizes of the active electro-acoustic transducer 136, as the active electro-acoustic transducer 136 must be sized to mechanically couple to the second flexible suspension element 114. Thus, shifting the second flexible suspension element 106 into the enclosure removes this size restriction, allowing designers greater flexibility in selecting the active electro-acoustic transducer 136.

Additionally, the arrangement second flexible suspension element 114 as shown in FIG. 1 results in the mass of the second enclosure element 112 being incorporated into the second passive radiator 110. This additional mass further limits the movement of the second passive radiator 110 during operation.

FIG. 2 is a cross-sectional view of a light bulb assembly including an acoustic device 100. As mentioned above, the force-balanced nature of the acoustic device 100, combined with the vibrational isolation provided by the second flexible suspension element 114 results in little to no unwanted vibrations in the first passive radiator structure 102. Accordingly, the acoustic device 100 is well suited for applications where vibration would be an impediment, such as wall or ceiling hangings, motor vehicles, and/or portable devices. In these examples, a rigid structure 122 may be mounted to the first passive radiator structure 102. The rigid structure 122 is then used to connect the acoustic device 100 to a particular receptacle, such as a light bulb socket or electrical outlet.

FIG. 2 depicts a particular example in which the acoustic device 100 is built into a light bulb. As shown, a mounting plate 128 is affixed to the first passive radiator structure 102. The mounting plate 128 is attached to one or more feet 126. The feet 126 are connected to a threaded mount 124 for screwing the light bulb into a socket. The minimal vibrations within the first passive radiator 102 allow for the maintenance of a connection between the threaded mount 124 and a receiving socket. Further, the feet 126 form one or more openings arranged around the passive diaphragm 104. These openings allow the low frequency audio generated by the passive diaphragm 104 to escape the light bulb and be heard by a user. This low frequency audio may be configured to compliment the audio generated by the active electro-acoustic transducer 116.

Figure 3:
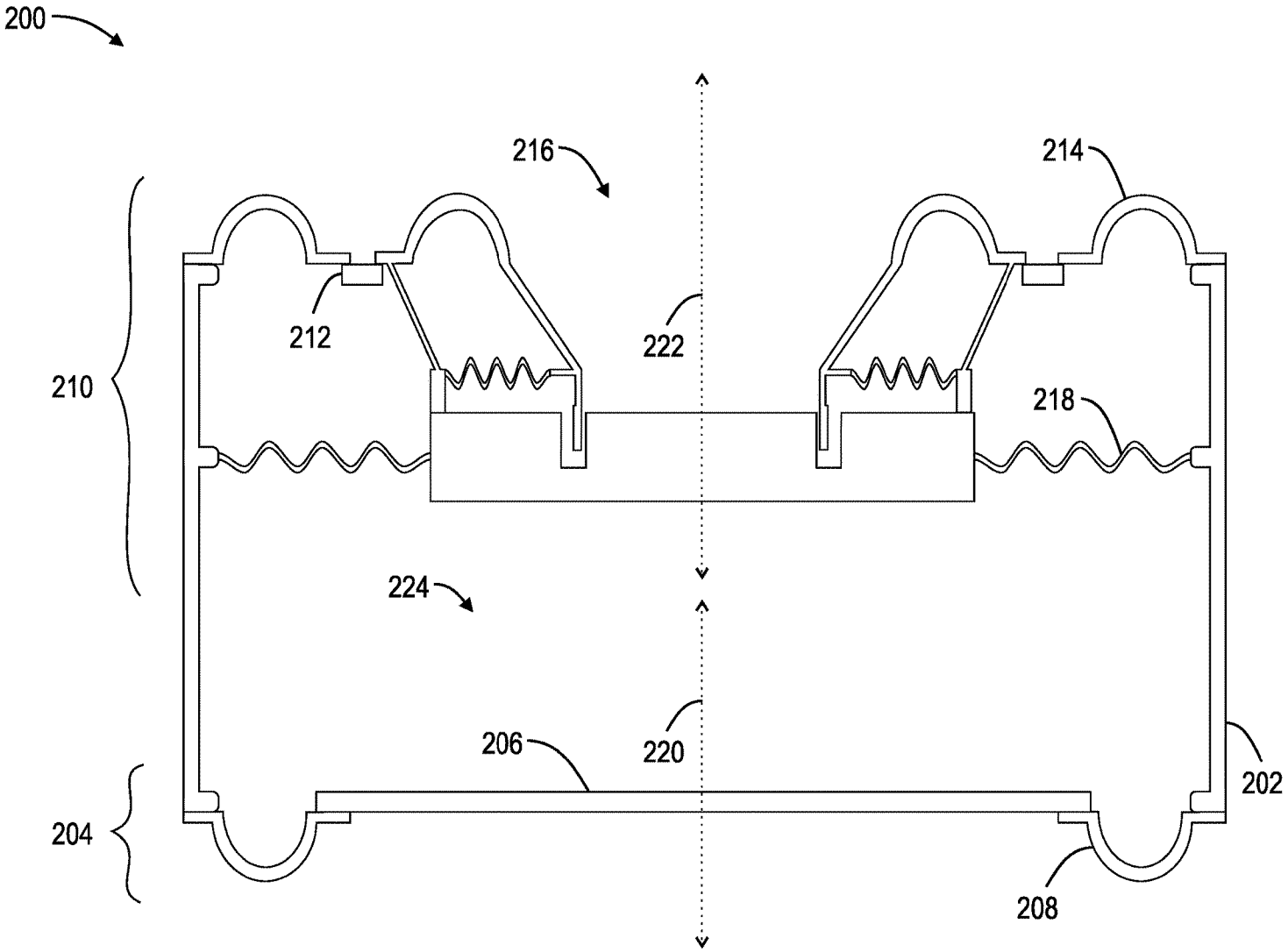
FIG. 3 is a cross-sectional view of an acoustic device, according to a further example.

FIG. 3 illustrates a variation of the acoustic device 100 of FIG. 1. The acoustic device 200 of FIG. 3 includes an enclosure 202, a first passive radiator structure 204, a second passive radiator structure 206, and a flexible spider 218. The first passive radiator structure 204 includes a first passive diaphragm 206. The first passive diaphragm 206 is mechanically coupled to the enclosure 202 via a first flexible suspension element 208.

The second passive radiator structure 210 includes a second passive diaphragm 212. The second passive diaphragm 212 is mechanically coupled to the enclosure 202 via a second flexible suspension element 214. The second passive radiator structure 210 also includes an active electro-acoustic transducer 216 mechanically coupled to the second passive diaphragm 212. The inclusion of the active electro-acoustic transducer 216 results in the second passive radiator structure 210 having a second mass which is much greater than a first mass of the first passive radiator structure 204. Further, in this example, the diameter of the first flexible suspension element 208 must be equal to the diameter of the second flexible suspension element 214 to ensure vibrational balance within the acoustic device.

The acoustic device 200 further includes a flexible spider 218 mechanically coupling the active electro-acoustic transducer 216 to the enclosure 202. The flexible spider 218 may be made of rubber or another similarly flexible material. The flexible spider 218 is arranged to maintain the centeredness of the active electro-acoustic transducer 216 within the enclosure 102. Further, the flexible spider 218 can be arranged to prevent unwanted movement and/or rocking of the active electro-acoustic transducer 216.

As with the example of FIG. 1, pressure changes within an internal cavity 224 of the enclosure 202 displace the first passive radiator structure 204 (including the first passive diaphragm 206) and the second passive radiator structure 210 (including the second passive diaphragm 212) relative to the enclosure 202. The first passive diaphragm 206 will be displaced at a greater distance than the second passive diaphragm 212 due to the extra mass of the active electro-acoustic transducer 216. The first passive radiator structure 204 may radiate along a first vibration axis 220, while the second passive radiator structure may vibrate along a second vibration axis 222. The first 220 and second 222 vibration axes may be substantially parallel or substantially collinear.

Figure 4:
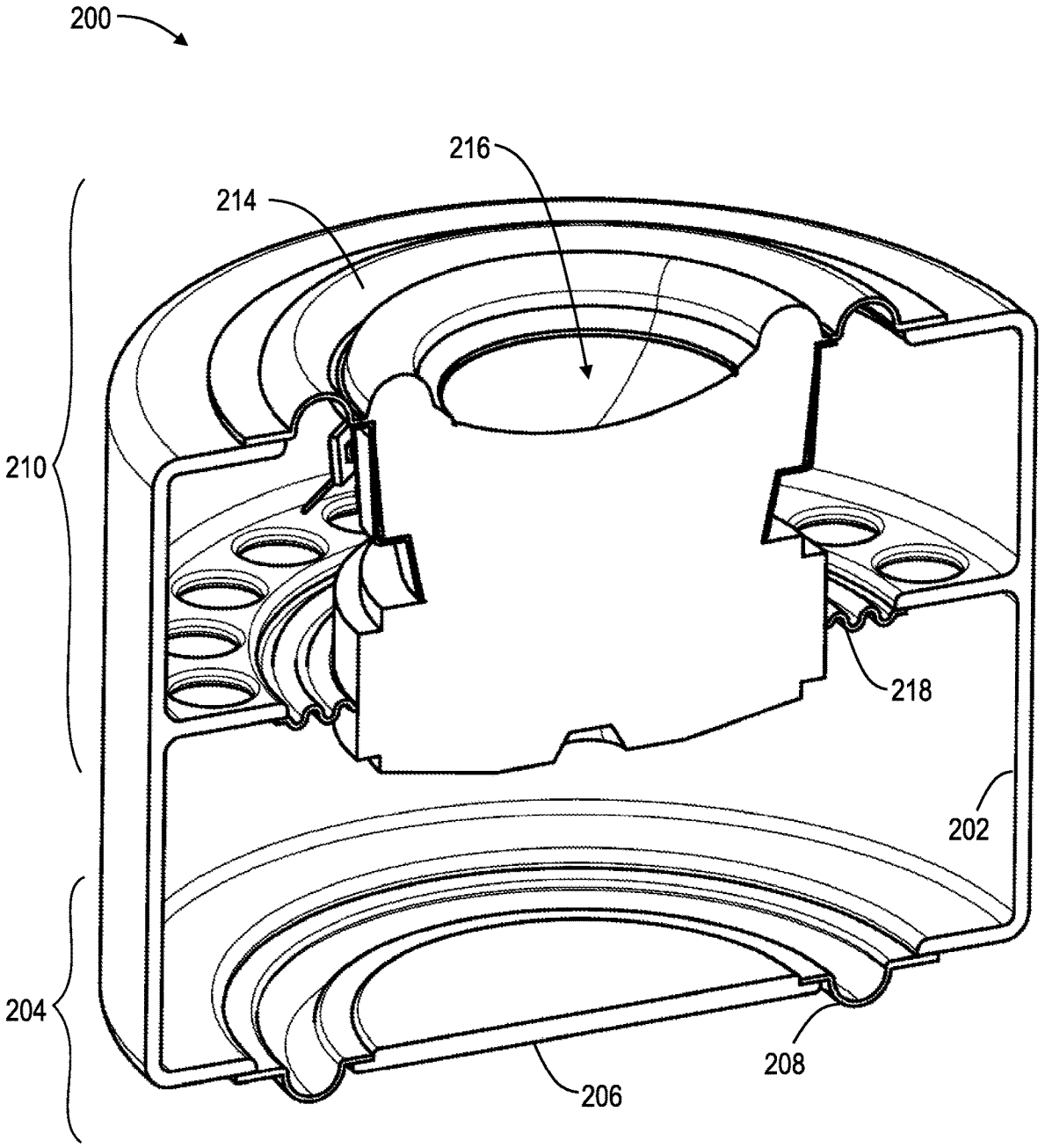
FIG. 4 is a cross-section of an isometric view of an acoustic device, according to the further example.

FIG. 4 is a cross-section of an isometric view of an acoustic device 200 shown in FIG. 3. As shown in FIG. 4, the enclosure 202 is substantially cylindrical. Further, the various components of the acoustic device 200, such as the first passive diaphragm 206, the first 208 and second 214 flexible suspension elements, and the flexible spider 218 are substantially circular.

Figure 5:
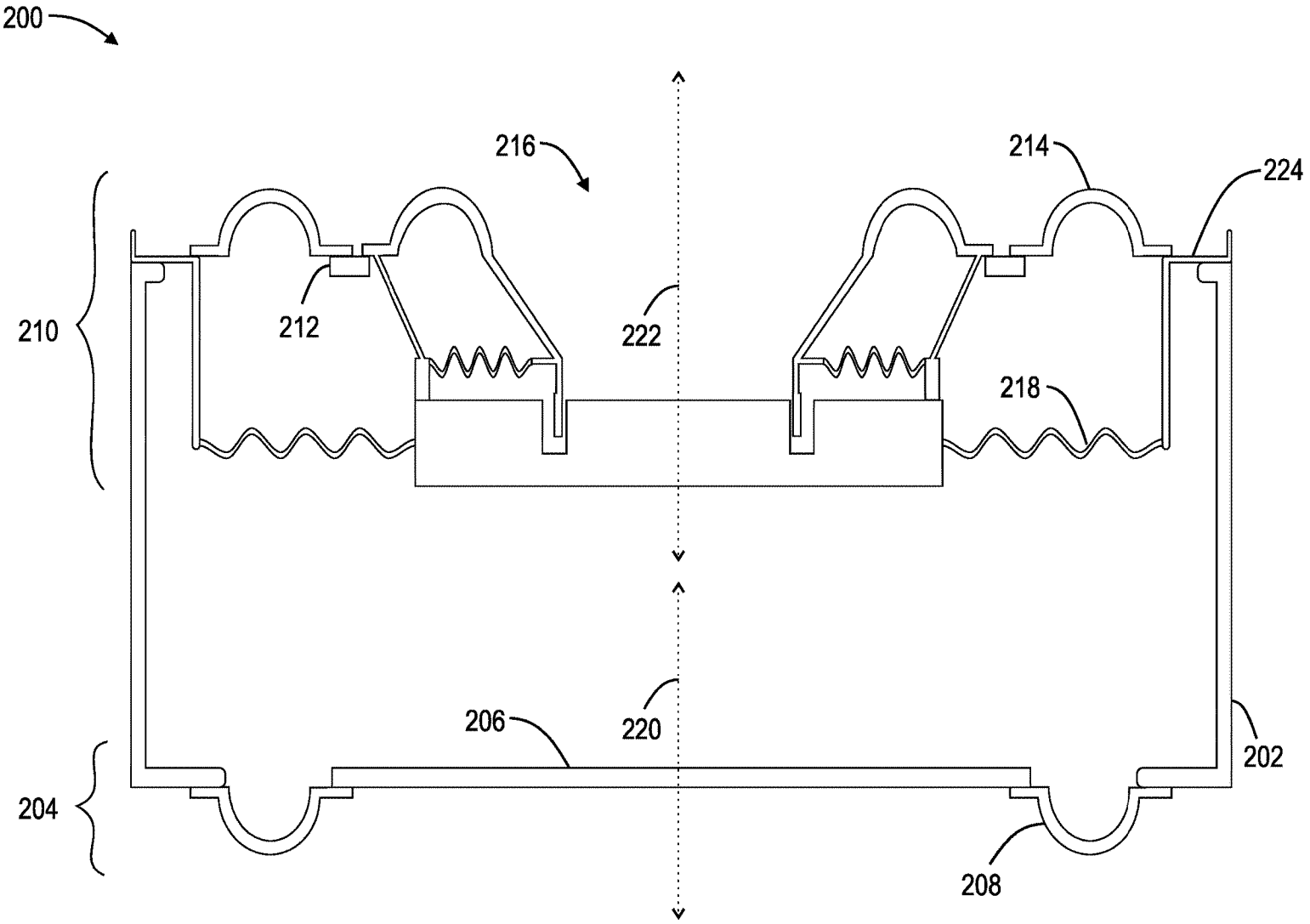
FIG. 5 is a cross-sectional view of an acoustic device, according to an even further example.

FIG. 5 illustrates a variation of the acoustic device 200 of FIG. 3. The acoustic device 200 of FIG. 5 includes a basket 224 mechanically coupled to the flexible spider 218 and the second flexible suspension member 214. The lip of the basket meets on the top edge of the enclosure 102. Thus, a user may efficiently remove the components of the second passive vibrating structure 210, including the active electro-acoustic transducer 216, by removing the basket 224 from the acoustic device 200.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements can optionally be present other than the elements specifically identified by the "and/or" clause, whether related or unrelated to those elements specifically identified.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements can optionally be present other than the elements specifically identified within the list of elements to which the phrase "at least one" refers, whether related or unrelated to those elements specifically identified.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

The above-described examples of the described subject matter can be implemented in any of numerous ways. For example, some aspects can be implemented using hardware, software or a combination thereof. When any aspect is implemented at least in part in software, the software code can be executed on any suitable processor or collection of processors, whether provided in a single device or computer or distributed among multiple devices/computers.

The flowchart and block diagrams in the Figures illustrate the architecture, functionality, and operation of possible implementations of systems, methods, and computer program products according to various examples of the present disclosure. In this regard, each block in the flowchart or block diagrams can represent a module, segment, or portion of instructions, which comprises one or more executable instructions for implementing the specified logical function(s). In some alternative implementations, the functions noted in the blocks can occur out of the order noted in the Figures. For example, two blocks shown in succession can, in fact, be executed substantially concurrently, or the blocks can sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

Other implementations are within the scope of the following claims and other claims to which the applicant can be entitled.

While various examples have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the examples described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific examples described herein. It is, therefore, to be understood that the foregoing examples are presented by way of example only and that, within the scope of the appended claims and equivalents thereto, examples can be practiced otherwise than as specifically described and claimed. Examples of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

What is claimed is:

1. An acoustic device, comprising:

a first passive radiator structure comprising a passive diaphragm, wherein the passive diaphragm is mechanically coupled to a first enclosure member via a first flexible suspension element; and a second passive radiator structure comprising:

a second enclosure member;

a second flexible suspension element directly coupled to the first enclosure member and the second enclosure member; and an active electro-acoustic transducer mechanically coupled to the second enclosure member, wherein the second passive radiator structure moves when the active electro-acoustic transducer vibrates;

wherein a first mass of the first passive radiator structure is less than a second mass of the second passive radiator structure.

2. The acoustic device of claim 1, wherein the first enclosure member is inflexible.

3. The acoustic device of claim 1, wherein the second enclosure member is inflexible.

4. The acoustic device of claim 1, wherein the passive diaphragm is configured to vibrate relative to the first enclosure member.

5. The acoustic device of claim 1, wherein the second passive radiator structure is configured to vibrate relative to the first enclosure member.

6. The acoustic device of claim 1, wherein the passive diaphragm is configured to vibrate along a first vibration axis and the second passive radiator structure is configured to vibrate along a second vibration axis.

7. The acoustic device of claim 6, wherein the first vibration axis and the second vibration axis are substantially parallel or substantially collinear.

8. The acoustic device of claim 1, wherein a stiffness ratio of a first stiffness of the first passive radiator structure to a second stiffness of the second passive radiator structure is substantially equal to a mass ratio of the first mass to the second mass.

9. The acoustic device of claim 1, wherein the first passive radiator structure and the second passive radiator structure vibrate in opposition.

10. The acoustic device of claim 1, wherein the second flexible suspension element is a gasket.

11. The acoustic device of claim 1, wherein the first enclosure member, the second enclosure member, and the second flexible suspension element form an enclosure.

12. The acoustic device of claim 11, wherein pressure changes within the enclosure generated by the active electro-acoustic transducer apply a first force to the first passive radiator structure and a second force to the second passive radiator structure.

13. The acoustic device of claim 12, wherein the first force and the second force are balanced.

14. The acoustic device of claim 12, wherein:

the first force displaces the passive diaphragm by a first displacement distance;

the second force displaces the second passive radiator structure by a second displacement distance; and the first displacement distance is greater than the second displacement distance.

15. The acoustic device of claim 1, wherein the active electro-acoustic transducer is rigidly mounted to the second enclosure member.

16. The acoustic device of claim 1, further comprising a rigid structure coupled to the first enclosure member, wherein the rigid structure is configured to support the first enclosure member.

17. The acoustic device of claim 16, wherein the rigid structure comprises at least one of a threaded mount, one or more feet, and a mounting plate.

18. The acoustic device of claim 1, wherein a first Q-factor of the first passive radiator structure is substantially equal to a second Q-factor of the second passive radiator structure.

19. The acoustic device of claim 1, wherein a first effective radiating area of the first passive radiator structure is substantially equal to a second effective radiating area of the second passive radiator structure.

20. An acoustic device, comprising:

an enclosure;

a first passive radiator structure comprising a first passive diaphragm, wherein the first passive diaphragm is mechanically coupled to the enclosure via a first flexible suspension element;

a second passive radiator structure comprising:

a second passive diaphragm mechanically coupled to the enclosure via a second suspension element; and an active electro-acoustic transducer mechanically coupled to the second passive diaphragm, wherein the second passive radiator structure moves when the active acoustic transducer vibrates; and a flexible spider directly coupling the active electro-acoustic transducer to the enclosure;

wherein a first mass of the first passive radiator structure is less than a second mass of the second passive radiator structure.

21. The acoustic device of claim 20, wherein pressure changes within the enclosure displace the first passive diaphragm and the second passive radiator structure relative to the enclosure.

22. The acoustic device of claim 21, wherein the first passive diaphragm is displaced at a greater distance than the second passive radiator structure.

23. The acoustic device of claim 20, wherein the first passive diaphragm is configured to vibrate along a first vibration axis, and the second passive diaphragm is configured to vibrate along a second vibration axis.

24. The acoustic device of claim 23, wherein the first vibration axis and the second vibration axis are substantially parallel or substantially collinear.

* * * * *